US006544315B2

(12) United States Patent
Har-Shai

(10) Patent No.: US 6,544,315 B2
(45) Date of Patent: Apr. 8, 2003

(54) SINTERED JEWELRY AND DECORATIVE ARTICLES

(76) Inventor: Gadi Har-Shai, 27 Pashosh St., Hod HaSharon (IL), 45354

( * ) Notice: Subject to any disclaimer, the term of this patent is extended or adjusted under 35 U.S.C. 154(b) by 0 days.

(21) Appl. No.: 09/803,109

(22) Filed: Mar. 12, 2001

(65) Prior Publication Data

US 2002/0127128 A1 Sep. 12, 2002

(51) Int. Cl.[7] ..... B22F 3/00; C22C 5/00
(52) U.S. Cl. ..... 75/247; 419/23; 419/38
(58) Field of Search ..... 419/23, 38; 75/247; 428/546

(56) References Cited

U.S. PATENT DOCUMENTS 3,975,194 A * 8/1976 Farnand et al.
4,608,307 A * 8/1986 Nakano et al. ..... 428/402
4,711,660 A * 12/1987 Kemp, Jr. et al.
4,925,740 A * 5/1990 Norris et al. ..... 428/547
5,376,328 A * 12/1994 Hoshino et al. ..... 419/36
5,441,695 A * 8/1995 Gladden ..... 419/37
5,702,501 A * 12/1997 Osawa et al. ..... 75/255
5,799,386 A * 9/1998 Ingersoll et al. ..... 29/527.5
5,928,778 A * 7/1999 Takahashi et al. ..... 428/323
6,325,839 B1 * 12/2001 Prasad et al. ..... 75/247

FOREIGN PATENT DOCUMENTS

DE 3841903 A1 * 6/1990

OTHER PUBLICATIONS

Abstracted Publication No.: DE 3841903 A1.*

* cited by examiner

*Primary Examiner*—Ngoclan Mai
(74) *Attorney, Agent, or Firm*—Edward Langer, Pat. Atty; Shiboleth, Yisraeli, Rober, Zisman & Co.

(57) ABSTRACT

An item of jewelry or decorative article of attractive and original appearance, formed from spheres of sinterable material using a low pressure sintering process such that the spheres retain their individual shapes. The spheres may have diameters in the range 0.1–2.0 mm and may be solid or hollow. Items may be produced using a combination of materials and sphere sizes and may combine elements produced by sintering and by casting. Items of jewelry produced by this method are lighter and more comfortable to wear than those produced by casting.

21 Claims, 3 Drawing Sheets

SINTERED JEWELRY AND DECORATIVE ARTICLES

FIELD OF THE INVENTION

The present invention relates to articles produced by sintering and in particular to lightweight jewelry and decorative articles of novel appearance produced by sintering of spherical particles of precious metals.

BACKGROUND OF THE INVENTION

Casting is generally the chosen method for production of jewelry from precious metals, such as karat gold, silver, and platinum, since creation of a three-dimensional object of complex shape from a metal is difficult unless the metal is melted.

Casting may be an extremely expensive method in the case of metals, which have a high melting point, such as platinum and titanium, necessitating heating of casting furnaces to extremely high temperatures Sintering was originally developed as an alternative to casting from molten metal or forging at softening temperatures. Sintering involves welding together of small particles of metal by heating to a temperature below the melting point of the metal, under appropriate atmospheric conditions.

Sintering requires heating of the metal to a temperature corresponding to approximately 80% of its melting point. The bonding between atoms is the same as that produced by casting.

The driving force in sintering is decreasing surface energy. As the sintering proceeds, adjacent particles partially coalesce due to diffusion processes so that the total surface area decreases.

Sintering generally involves powder particles, which may be produced by gas-assisted atomization. In this method, the metal is first heated above its liquidation temperature. The molten metal then flows through a nozzle whereupon a high-pressure gas stream breaks up the metal into small droplets, which upon cooling become metal powders. Gas pressure can be adjusted to produce droplets having the required dimensions, with increased gas pressure producing finer droplets.

Standard sintering of metals involves compacting the particulate metal into a desired shape under substantial pressure then sintering to cause bonding of the particles. This produces an article of high structural strength.

In gravity or low pressure sintering, a mold is filled with uncompacted metal powder then heated to sintering temperature. Gravity sintering is carried out under conditions of atmospheric pressure. In low pressure sintering, the pressure applied is less than that at which deformation of spheres occurs. The result is a low-density article in which particles are generally more uniform in size than those of high-density articles.

U.S. Pat. No. 6,062,045 to West discloses a jewelry item and method of making same using powdered sinterable metal. The method involves sintering of hard metal into a blank, to which a precious metal may then be affixed. High pressure is used in the process, resulting in a solid blank of desired shape. The jewelry item produced is similar in appearance to items produced by casting methods, but is wear resistant.

Use of spherical particles of precious metal rather than powdered metal would give a unique appearance to the surface of the article produced by sintering, providing attractive and original items of jewelry and decorative objects. Such items would have a lower density than an equivalent cast item, making them lighter and more comfortable to wear, and enabling air flow between spheres.

Therefore, it would be desirable to economically provide items of jewelry and decorative objects from precious metals in which the final product has a unique and attractive appearance and lower density than similar items produced by casting.

SUMMARY OF THE INVENTION

Accordingly, it is an object of the present invention to overcome the disadvantages of the prior art and provide a method for economical production of precious metal jewelry and decorative objects having a unique and attractive appearance and lighter weight than similar items produced by casting.

In accordance with a preferred embodiment of the present invention, there is provided an item of jewelry or decorative item formed from gravity or low pressure. sintered spheres of precious metal having a unique and attractive appearance.

According to a preferred embodiment, there is provided an article of jewelry of attractive and original appearance, formed by sintered spherical particles of precious metal.

A feature of the present invention is to provide an item of jewelry or decorative object having a unique appearance, from sintered spherical particles of precious metal.

An advantage of the present invention is that the item of jewelry or decorative object has a unique appearance.

A further advantage of the present invention is that such items have lower density than similar items produced by casting, making items of jewelry lighter and more comfortable to wear.

A further advantage of the present invention is that such items are more economical to produce than similar items produced by casting, due to lower material requirements, since a larger volume is obtained per unit weight.

A further advantage of the present invention is that such items comprise spherical units, and are therefore devoid of sharp corners.

A further advantage of the present invention is that such items may be formed by combining spheres of various sizes, colors and materials, while retaining their individual characteristics.

Additional features and advantages of the invention will become apparent from the following drawings and description.

BRIEF DESCRIPTION OF THE DRAWINGS

For a better understanding of the invention with regard to the embodiments thereof, reference is made to the accompanying drawings, in which like numerals designate corresponding sections or elements throughout, and in which.

DETAILED DESCRIPTION OF THE PREFERRED EMBODIMENTS

Figure 1A:
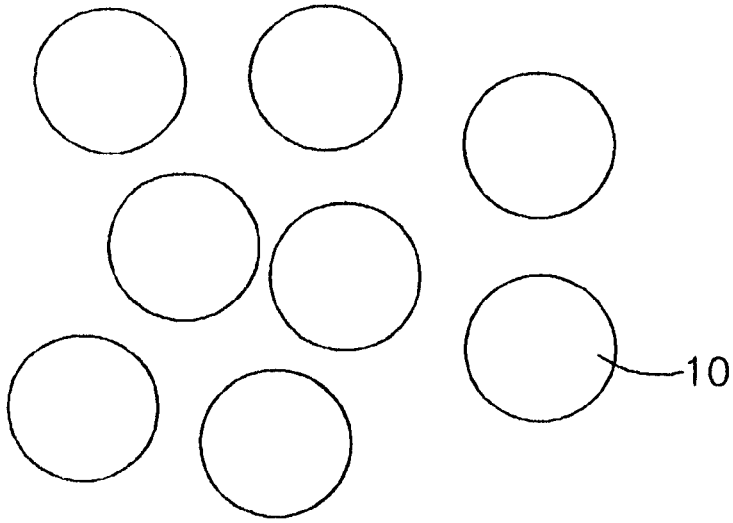
FIGS. 1*a* and *b* show spherical particles of precious metal, before and after sintering, respectively.
Figure 1B:
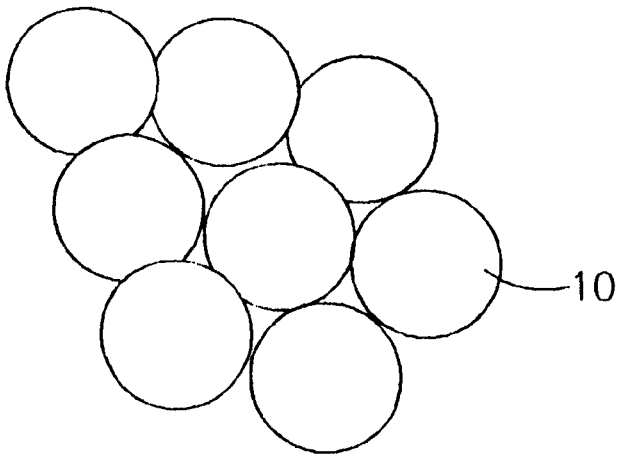

Referring now to FIGS. 1*a* and 1*b*, individual spherical particles 10 of precious metal are shown before and after sintering, respectively. Gravity or low pressure sintering may be used. As can be seen in FIG. 1*b*, after sintering the particles are welded together while maintaining their individual spherical shapes. The coalescence is produced by metal-to-metal bonds. No change in color is produced by sintering of spherical particles of precious metals.

Spheres 10 may be produced by gas-assisted atomization in which compressed gas (frequently air) is used to break up a molten metal into very fine particles. Particle size is inversely proportional to gas pressure, therefore gas pressure may be reduced to produce spherical particles 10 having diameters in the range 0.1–2.0 mm, rather than fine powders, resulting in a range of jewelry and decorative items of different appearance. The spherical particles produced may be either solid or hollow. The spheres are then sorted by sieving or other sorting techniques, to obtain spheres of even size.

The atomization process requires only a small amount of material to be melted at a time, resulting in low overall energy consumption.

FIGS. 2*a–d* illustrates the process of sintering as applied to production of a ring. In this example, a mold of desired shape is filled with a mixture of spherical particles.

Figure 2A:
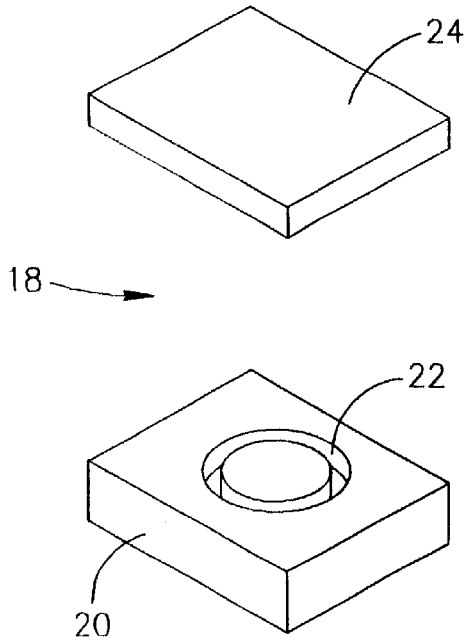
FIGS. 2*a–d* shows production of a ring by sintering.

FIG. 2*a* illustrates a mold 18, which in this example comprises a box-shaped base 20 formed with a ring-shaped depression 22 and provided with a lid 24. Mold 18 may be formed from metal or ceramic material.

Figure 2B:
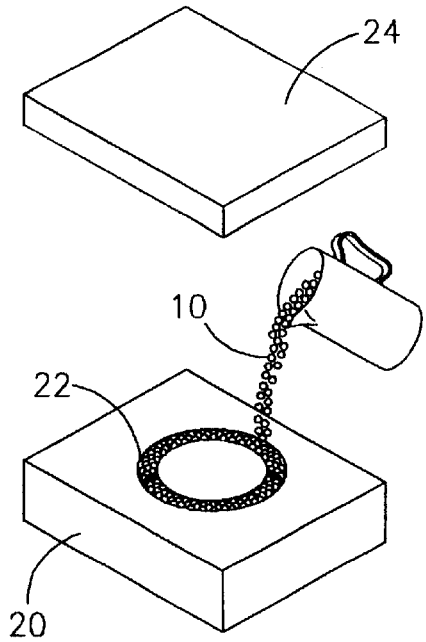
Figure 2C:
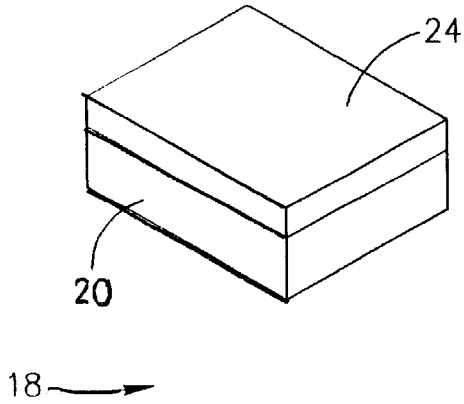

As can be seen in FIG. 2*b*, the particles 10 for sintering are poured into the depression 10 of mold 20. Alternatively, particles 10 may be injected into mold 18. Lid 24 is then replaced on base 20, as shown in FIG. 2*c*. Mold 18 is subjected to vibration to ensure even distribution of particles 10.

The process may be carried out using gravity sintering, in which no external pressure is applied, or by low pressure sintering.

The mixture is then sintered in any suitable furnace by heating to a temperature corresponding to approximately 80% of the melting point of the metal and held at that temperature for a requisite time period, usually in the range of 15–25 minutes. Optimum temperature and time are dependent on the sphere size, type of metal being sintered and equipment used.

Additional chemical or mechanical finishing processes may be applied, such as polishing, buffing, steam cleaning, plating, ultrasonic cleaning etc. These processes are used to achieve shiny, matte or semi-matte finishes, as required, as well as to clean the item.

Figure 2D:
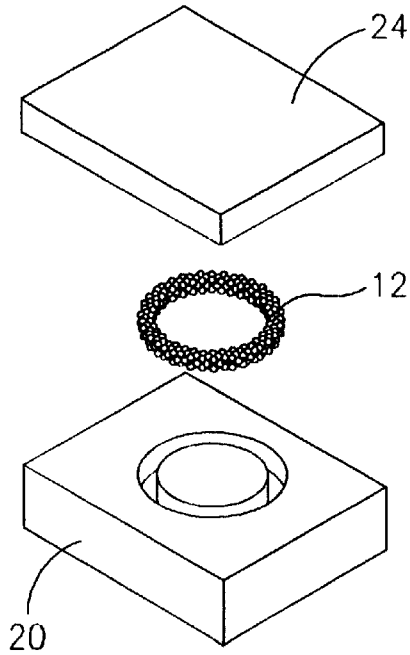

In the example illustrated in FIG. 2*d*, the result is a ring 12, having a surface comprising coalesced spherical particles 10, giving a unique, attractive, lightweight item of jewelry.

The sintering process is very efficient compared with other processes such as casting or machine cutting. Parts can be molded with very intricate features that eliminate much of the cutting that is required with conventional machining. Molds are typically capable of many service hours before wearing out and requiring replacement. Since almost all of the metal particles, which enter the mold, become part of the finished product, the process is highly materials efficient.

Structural strength and integrity are imparted to the resulting article by the metal-to-metal bonds formed during sintering, while the shape of the article is that of the mold in which the particles were sintered.

Figure 3A:
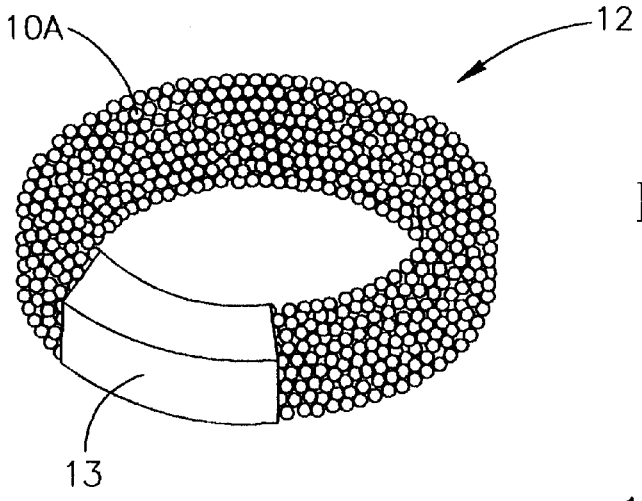
FIGS. 3*a–c* shows articles of jewelry and decorative articles produced by sintering.
Figure 3B:
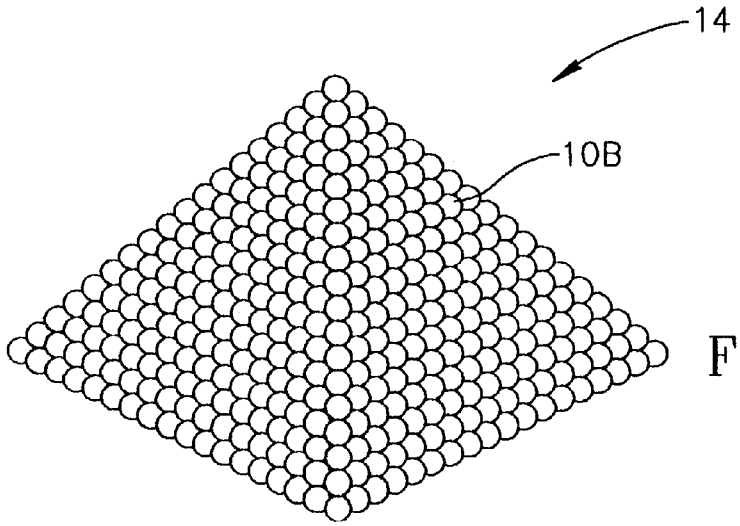
Figure 3C:
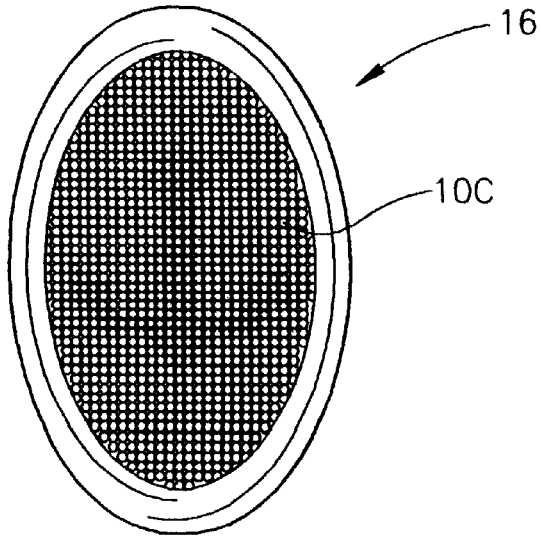

FIGS. 3*a–c* illustrate examples of decorative and jewelry items produced by sintering of spherical particles 10 of various diameters.

FIG. 3*a* illustrates a ring 12 produced using medium-sized spherical particles 10*a* combined with a portion 13 produced by casting; FIG. 3*b* illustrates a pyramidal decorative item 14 in which large spherical particles 10*b* are used; and FIG. 3*c* illustrates a brooch 16 formed from small spherical particles 10*c*.

A wide variety of shapes may be produced by use of corresponding molds. A wide range of jewelry items may be produced by this method, including rings, bracelets, earrings, pendants, chains of various link design, and the like.

The process may be applied to all sinterable precious metals, including pare gold, karat gold, silver, platinum and titanium, either individually or in combination. Various combinations of sphere size and metal type may be used. Sintering may also be applied to gems, including diamonds, or gems may be set into the metal as desired. Sintering may also be used in combination with casting.

Gravity or low pressure sintering of spherical particles results in a product of lower density than similar items produced by casting, making jewelry items lighter and more comfortable to wear.

Gravity or low pressure sintering of spherical metal particles maintains the integrity of the individual spheres, such that individual spheres can be clearly seen by an observer. The eye of the observer is therefore drawn to both the overall shape of a jewelry or decorative item and to the shape of the individual spheres which form the surface of the item. The effect is highly attractive and unusual.

Having described the invention with regard to certain specific embodiments thereof, it is to be understood that the description is not meant as a limitation, since further modifications will now suggest themselves to those skilled in the art, and it is intended to cover such modifications as fall within the scope of the appended claims.

I claim:

1. A decorative article distinctive appearance having at least a portion solely formed from spheres of sinterable, flowable, binderless materials, said spheres having diameters in the range 200–2000 microns, in a low pressure sintering process, said spheres retaining their shape in the decorative article, such that the decorative article has lower density than that of an equivalent article produced by casting.

2. The article of claim 1 wherein said spheres comprise precious metal.

3. The article of claim 1 wherein said spheres comprise gems.

4. The article of claim 3 wherein said gems comprise diamonds.

5. The article of claim 1 wherein said spheres are solid.

6. The article of claim 1 wherein said spheres are hollow.

7. The article of claim 6 wherein said spheres are of different sizes and are used in combination.

8. The article of claim 2 wherein said precious metal is pure gold.

9. The article of claim 2 wherein said precious metal is karat gold.

10. The article of claim 2 wherein said precious metal is silver.

11. The article of claim 2 wherein said precious metal is platinum or platinum alloy.

12. The article of claim 2 wherein said precious metal is titanium or titanium alloy.

13. The article of claim 2 formed from a combination of precious metals.

14. The article of claim 1 comprising a ring.

15. The article of claim 1 comprising an earring.

16. The article of claim 1 comprising a necklace.

17. The article of claim 1 comprising a bracelet.

18. The article of claim 1 comprising a chain.

19. The article of claim 1 comprising a brooch.

20. The article of claim 1 comprising a pendant.

21. A method for producing a decorative article of distinctive appearance from spheres of sinterable, flowable, binderless material in a low pressure sintering process comprising:

providing spheres of precious metal having diameters in the range 200–2000 microns;

transferring said spheres to a mold having a desired shape; and sintering said mold containing said spheres to produce the decorative article, in which the spheres retain their shape, such that the decorative article has lower density than that of an equivalent article produced by casting.

* * * * *